US010322045B1

(12) United States Patent
Cuneo

(10) Patent No.: US 10,322,045 B1
(45) Date of Patent: Jun. 18, 2019

(54) FOOTBOARD FOR HOSPITAL BED WITH THERAPEUTIC MECHANISMS HOUSED WITHIN

(71) Applicant: Paul Cuneo, Berlin, NJ (US)

(72) Inventor: Paul Cuneo, Berlin, NJ (US)

( * ) Notice: Subject to any disclaimer, the term of this patent is extended or adjusted under 35 U.S.C. 154(b) by 920 days.

(21) Appl. No.: 14/290,010

(22) Filed: May 29, 2014

Related U.S. Application Data

(60) Provisional application No. 61/828,328, filed on May 29, 2013.

(51) Int. Cl.

| | |
|---|---|
| ***A61G 7/00*** | (2006.01) |
| ***A61H 23/00*** | (2006.01) |
| ***A61H 23/04*** | (2006.01) |
| ***A61G 7/018*** | (2006.01) |
| ***A61G 7/05*** | (2006.01) |
| ***A61H 9/00*** | (2006.01) |

(52) U.S. Cl.
CPC ..... *A61G 7/018* (2013.01); *A61G 7/0506* (2013.01); *A61H 9/00* (2013.01); *A61H 9/0021* (2013.01); *A61H 2009/0042* (2013.01); *A61H 2201/0103* (2013.01); *A61H 2201/0107* (2013.01); *A61H 2201/0142* (2013.01); *A61H 2201/02* (2013.01); *A61H 2201/0207* (2013.01); *A61H 2201/1409* (2013.01); *A61H 2201/5002* (2013.01)

(58) Field of Classification Search
CPC ..... A61H 9/00; A61H 9/0007; A61H 9/0028; A61H 2009/0035; A61H 2009/0042; A61H 9/005; A61H 9/0078; A61H 9/0085; A61H 9/0092; A61H 23/04; A61H 2201/0107; A61H 2201/0119; A61H 2201/0138; A61H 2201/0142; A61H 2201/02; A61H 2201/0207; A61H 2201/0214; A61H 2201/1409; A61H 2201/0242; A61H 2201/0221; A61F 2007/0054–0069; A47C 19/022; A61G 7/0506
See application file for complete search history.

(56) References Cited

U.S. PATENT DOCUMENTS

| | | | | |
|---|---|---|---|---|
| 5,230,489 | A * | 7/1993 | White | F16L 3/233 24/16 PB |
| 5,329,656 | A * | 7/1994 | Leggett | A47C 27/084 5/420 |
| 5,377,372 | A | 1/1995 | Rudolf et al. | |
| 5,448,788 | A * | 9/1995 | Wu | A47C 21/048 5/421 |

(Continued)

FOREIGN PATENT DOCUMENTS

EP 2036524 A2 3/2009

*Primary Examiner* — Michael J Tsai
*Assistant Examiner* — Tu A Vo
(74) *Attorney, Agent, or Firm* — Cramer Patent & Design, PLLC; Aaron R. Cramer

(57) ABSTRACT

A therapy control system provides a control panel attachable to a footboard portion of a hospital bed, containing a variety of therapeutic devices along with corresponding electrical and fluid interfaces. The system also provides an informational display for each therapeutic device and various push buttons to activate, configure settings, and program the devices. The system is capable of facilitating therapeutic devices such as heat therapy, sequential therapy, foot therapy, and an air mattress inflation function.

5 Claims, 4 Drawing Sheets

(56) References Cited

U.S. PATENT DOCUMENTS 5,611,096 A * 3/1997 Bartlett ..... A61G 7/001 5/424
5,647,079 A * 7/1997 Hakamiun ..... A61G 7/05776 285/124.3
5,894,615 A * 4/1999 Alexander ..... A47C 21/044 165/46
6,314,597 B2 11/2001 Heimbrock et al.
6,321,878 B1 * 11/2001 Mobley ..... A61G 7/00 188/1.12
6,551,348 B1 * 4/2003 Blalock ..... A61F 7/0085 137/334
7,171,708 B2 2/2007 Osborne et al.
7,464,425 B2 * 12/2008 Chambers ..... A61G 7/05776 5/739
7,480,948 B2 1/2009 Reinke et al.
7,735,266 B2 * 6/2010 Gallant ..... A61G 7/00 312/209
7,779,493 B2 * 8/2010 Lemire ..... A61G 7/018 340/573.1
8,334,777 B2 12/2012 Wilson et al.
8,689,376 B2 * 4/2014 Becker ..... A61B 5/1115 5/600
9,072,577 B1 * 7/2015 Ferko, III ..... A61F 7/00
2003/0061664 A1 * 4/2003 Salvatini ..... A61G 7/05776 5/713
2003/0139255 A1 * 7/2003 Lina ..... A61F 13/065 482/24
2004/0168256 A1 * 9/2004 Chaffee ..... A47C 27/082 5/713
2004/0210176 A1 * 10/2004 Diana ..... A61H 9/0078 601/151
2005/0193494 A1 * 9/2005 Lau ..... A47C 27/081 5/706
2006/0258964 A1 * 11/2006 Biondo ..... A61H 9/0078 601/152
2007/0157385 A1 * 7/2007 Lemire ..... A61G 7/005 5/600
2008/0263771 A1 * 10/2008 Hakamiun ..... A61G 7/05 5/600
2009/0013470 A1 * 1/2009 Richards ..... A61G 7/05715 5/613
2009/0237264 A1 * 9/2009 Bobey ..... A61G 7/05776 340/815.69
2010/0076356 A1 * 3/2010 Biondo ..... A61H 9/0078 601/149
2010/0100017 A1 * 4/2010 Maguina ..... A61H 9/0078 601/152
2011/0030142 A1 2/2011 Karwal et al.
2012/0022414 A1 * 1/2012 Receveur ..... A61H 9/0078 601/96
2012/0079662 A1 * 4/2012 Dzioba ..... A61G 7/05776 5/713
2013/0231596 A1 * 9/2013 Hornbach ..... A61H 9/0078 601/150
2014/0276254 A1 * 9/2014 Varga ..... A61F 7/02 601/15
2015/0094623 A1 * 4/2015 Howell ..... A61G 7/05769 601/18

* cited by examiner

FOOTBOARD FOR HOSPITAL BED WITH THERAPEUTIC MECHANISMS HOUSED WITHIN

RELATED APPLICATIONS

The present invention was first described in and claims the benefit of U.S. Provisional Application No. 61/828,328, filed May 29, 2013, the entire disclosures of which are incorporated herein by reference.

FIELD OF THE INVENTION

The present invention relates to a footboard for a hospital bed having therapeutic mechanisms housed within, and having them electrically connected to a control panel.

BACKGROUND OF THE INVENTION

The hospital bed is perhaps the most common piece of medical equipment in hospitals and extended care facilities across the country. Patients typically spend most of their time in such beds, other than for tests or physical therapy. So, as one could imagine, patient care and comfort is of the utmost importance while in bed. In fact, many of the tests and physical therapy functions are being performed while a patient is in bed. To further this care, health care professionals rely on several different types of pumps. A T/pump is used to provide heat therapy to increase blood flow to affected body areas. A sequential pump is used to apply sequential compression to the lower limbs, and help prevent deep vein thrombosis. A foot pump is used to mimic the natural motion of walking, and help improve circulation of blood in the legs. An air mattress pump is used to inflate the air mattress upon which the patient lies to allow for individualized comfort. Unfortunately, all of these different pumps occupy space, have power cords, input and output tubing, and the like, which presents a haphazard and cluttered appearance. Should the wrong pump be disconnected due to tangled cords or tubing, patient care can even suffer. Accordingly, there exists a need for a means by which the various pumps and systems used in the care of a bedridden hospital patient can be organized to eliminate the problems as described above. The development of the footboard fulfills this need.

Prior art in this field consists of portable carts that transport such pumping equipment in and out of hospital rooms. While these carts are convenient and provide mobility, they fail to alleviate the clutter associated with the wiring and tubing that accompanies the use of such equipment. Furthermore, one lacks the easy access to, and storage of, the equipment because the carts must still be transported in and out of the room. Moreover, the carts still take up much needed space in the hospital room. Some hospital beds are equipped with foot-pedal controls to enable a caregiver to operate the functions of the bed, but these controls are dedicated to actuation of the bed structure. The foot-pedal controls of the prior art cannot be availed to operate the various pumps described above.

SUMMARY OF THE INVENTION

The invention is a therapy control system for a hospital bed that is housed within a hollow rectangular frame. This frame is adapted to be mounted to an existing footboard portion of an existing hospital bed, or become the footboard of the hospital bed. The frame is configured to contain at least one (1) therapeutic device, a fluid reservoir, and at least one (1) circuit board. A control panel is disposed on a surface of the frame to enable operational control and monitoring of the various therapeutic devices. The configuration of the system eliminates the clutter and inconvenient connectivity of stand-alone therapeutic devices.

The system is a framework mounted on to, or incorporated into, a footboard of a hospital bed, which provides a means to easily access and operate various pumps and equipment used in the care of a bedridden hospital patient. All of the controls and equipment are either housed within or onto the framework, which the framework itself becomes part of the footboard. This neat and compact configuration reduces clutter and improves overall patient care. The system utilizes the typically un-used space upon the front facing surface of the bed's footboard. A power supply connection is made to a conventional outlet, and internal distribution circuitry routes the power to multiple pump systems. The various pumps can then be controlled via a footboard mounted control panel. All of the pumps utilize plug-in ports for quick connection to the therapeutic pieces used on the patient. These features greatly reduce the clutter associated with independent pumps and their associated power wiring, power connections, control connections and tubing, thus creating a more controlled and organized appearance.

The frame is a hollowed structure with a removable control panel. Removing the control panel grants access into the frame and enables a user to maintenance and/or replace therapeutic devices housed within. The interior cavity of the frame is provided with a plurality of dividers to segment the internal space of the frame and facilitate containment of the various therapeutic devices and their associated wiring and tubing. The interior cavity is further provided with portals facilitating fluid and electrical interconnections between the fluid reservoir and each therapeutic device and enabling routing of wiring and tubing to an exterior of the frame. An integral fill connection and drain plug allow a user to replenish and replace fluids of the fluid reservoir when needed. The system preferable has a first circuit board and a second circuit board. The first circuit board provides microprocessor-based circuitry and software and a plurality of display drivers enabling data and status information to appear upon a plurality of digital displays of the control panel. The second circuit board communicates with the various therapeutic devices, performing input/output operations in accordance with algorithmic functions of software instructions within the first circuit board, and to provide power to motor portions of each therapeutic device. The second circuit board also receives input signals from the control panel.

It is an objective of the present invention to provide a therapy control system that is adaptable to virtually any footboard of a hospital bed.

It is a further objective of the present invention to provide a framework into which the therapy system is housed that is configured to be part of the footboard or become the footboard of a hospital bed.

It is a further objective of the present invention to configure the framework to utilize the interior space of the footboard to house at least one (1) therapy apparatus and all of the electronics and tubing associated with each therapy apparatus.

It is a further objective of the present invention to enable removable securement of each therapy apparatus within the framework and provide electrical and fluid connectors for each.

It is a further objective of the present invention to provide a fluid reservoir from which at least one (1) therapy apparatus may utilize to draw fluid from and circulate fluid through.

It is a further objective of the present invention to enable routing of tubing and wiring from each therapy apparatus though portals of the framework so as to employ them for therapy when desired.

It is a further objective of the present invention to provide at least one (1) circuit board to enable processing and data transfer for monitoring and control of each therapy apparatus via a control panel disposed on a surface of the framework.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
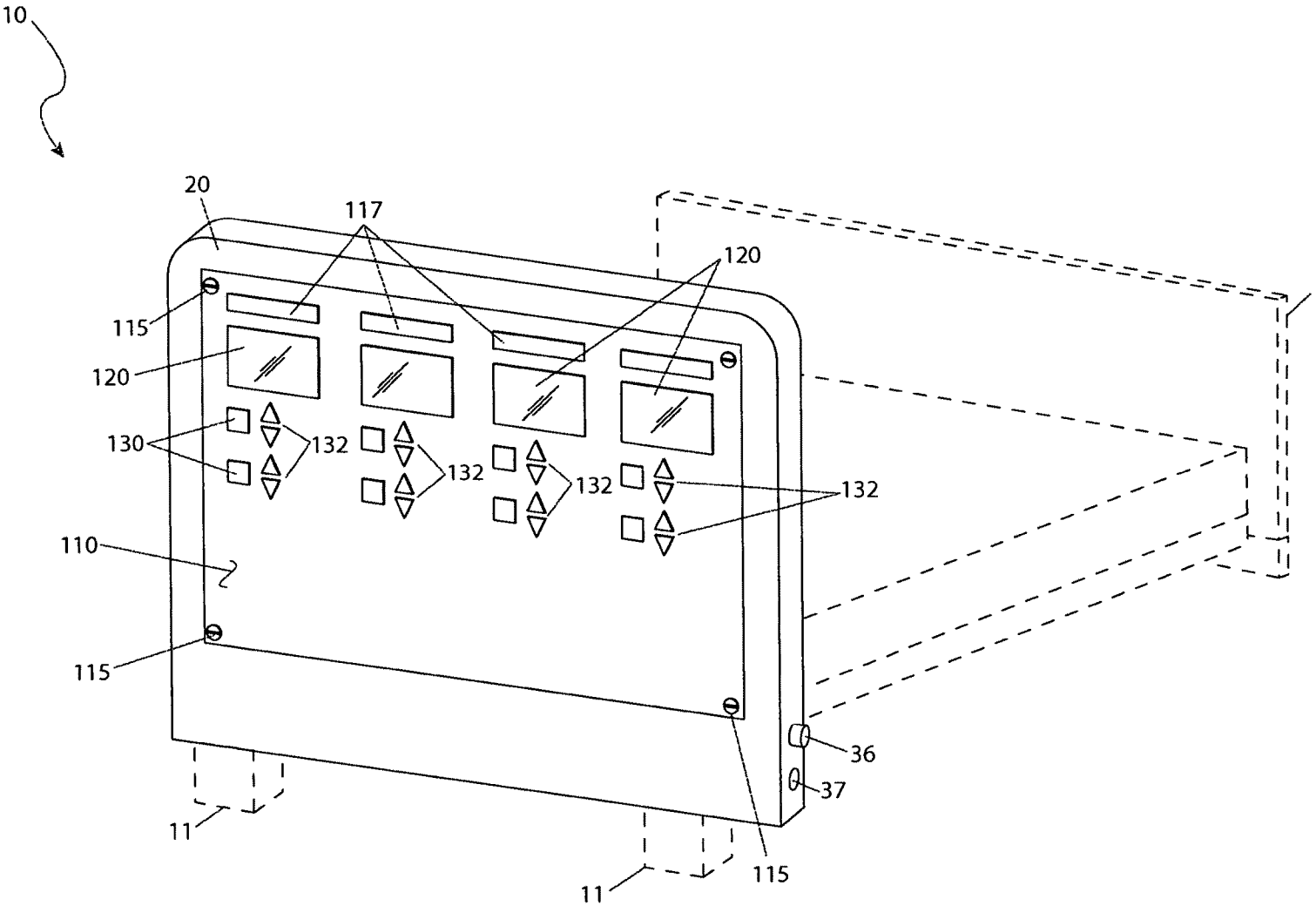
FIG. 1 is an environmental and perspective view of a therapy control system 10 for a hospital bed 11 comprising a footboard 20 with therapeutic mechanisms and controls housed within, according to a preferred embodiment of the present invention.

10 therapy control system
11 hospital bed
12 processing unit
20 system frame
30 therapeutic device
35 reservoir
36 fill connection
37 drain plug
70 cavity
72 divider
80 fastening strap
90 portal
100 first circuit board
102 wiring
103 power cord
105 second circuit board
107 circuit board connector
108 data cable
110 control panel
112 tubing
115 panel latch
117 label
120 display
130 activation switch
132 increment/decrement button
150 electrical connection
152 fluid connection

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a therapy control system for a hospital bed (herein described as the "system") 10, having a hollow rectangular system frame 20 being mounted to, or replacing an existing footboard portion of an existing hospital bed 11. The system frame 20 is to contain various therapeutic devices 30, a fluid reservoir 35, a first circuit board 100, and a second circuit board 105. The system 10 further provides a control panel 110 including a plurality of device displays 120 and push buttons 130, 132 being electrically connected to the therapeutic devices 30 to provide control, operation, and programming functions. The system 10 eliminates the impedance associated with a myriad of stand-alone devices, carts, wiring, and tubing that would otherwise clutter operational areas surrounding a hospital bed 11.

Figure 2:
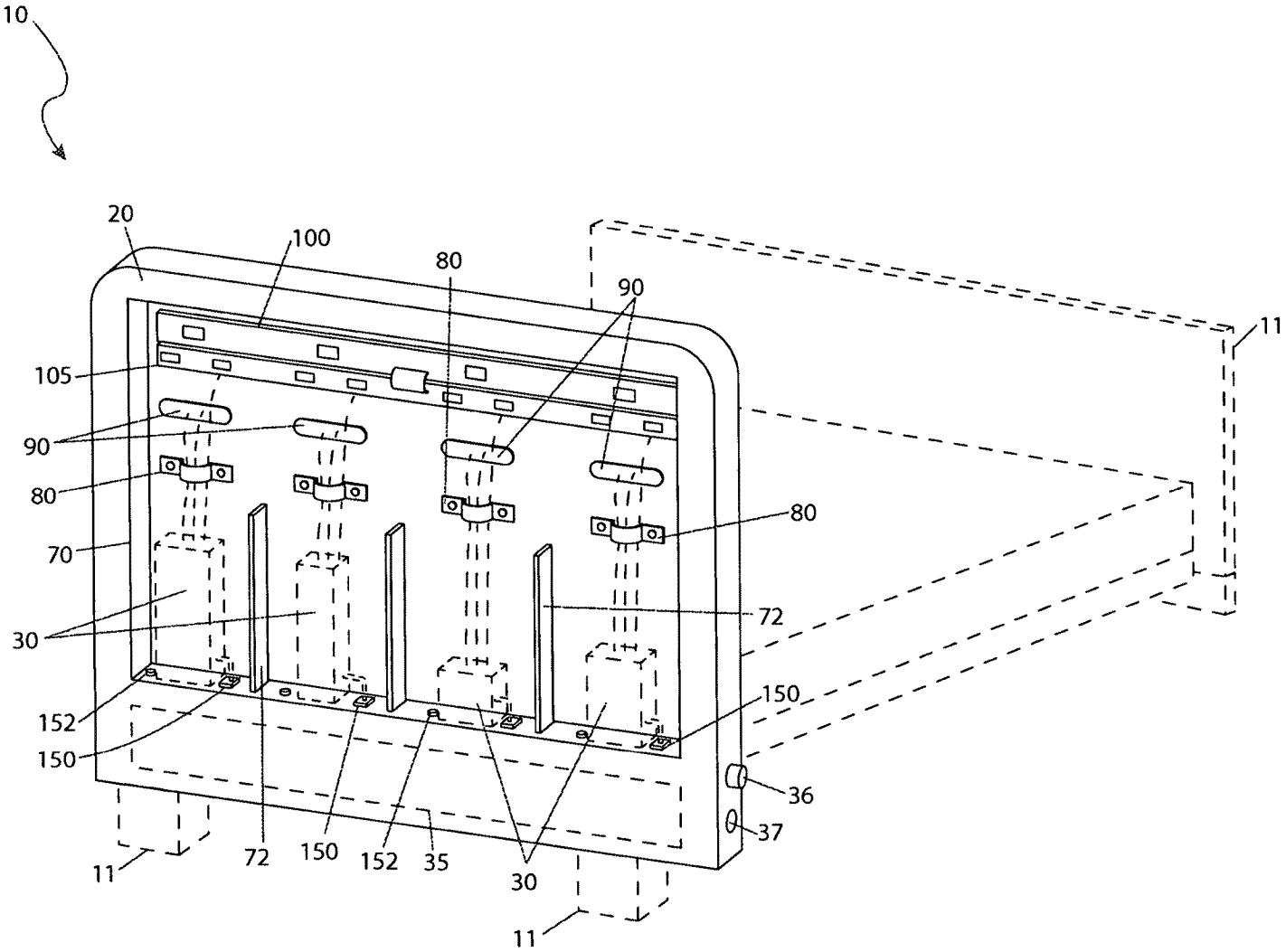
FIG. 2 is another perspective view of the therapy control system 10 depicting removal of a control panel portion 110, according to a preferred embodiment of the present invention.

Referring to FIGS. 1 and 2, environmental perspective views of the system 10, according to a preferred embodiment of the present invention, are disclosed. The system 10 provides a system frame portion 20 providing a hollowed structure serving to contain at least one (1) therapeutic device 30. The system frame 20 provides an open-front box-like form having a removable control panel 110 covering a rearward-facing surface. The system frame 20 provides a fastening means along perimeter edges for removable attachment of the control panel 110 using panel latching devices 115 such as, but not limited to: thumbscrew fasteners, half-turn latching mechanisms, or screws. The system frame 20 is envisioned to be fabricated from a rigid polymer material; however it is understood that other rigid materials having the ability to support the weight of the various devices placed within may be utilized without deviating from the teachings of the system 10, and as such should not be interpreted as a limiting factor of the system 10.

The control panel 110 provides a means to activate, operate, monitor status and settings, program, and select settings for the therapeutic devices 30 via a plurality of digital displays 120 and push buttons 130, 132. Each display 120 is to communicate settings and data for a corresponding therapeutic device 30. The displays 120 are envisioned to be of a digital type such as liquid crystal display (LCD), light emitting diode (LED), touch-screen, or current technology. The control panel 110 is further provided with labels 117 enabling a user to display pertinent information about each display 120.

The push buttons 130, 132 are envisioned to include a plurality of contact-closure devices such as activation switches 130 and a plurality of increment/decrement buttons 132; however, other various switching devices may be used with equal benefit, and as such should not be interpreted as a limiting factor of the system 10. The push buttons 130, 132 are used by a caregiver to operate the therapeutic devices 30 and to initiate therapeutic treatments to a patient lying in the hospital bed 11. An embodiment of the system 10 is illustrated here having each push button 130, 132 in electrical communication with the second circuit board 105 and is envisioned to be biased in a raised position, which upon being pressed, completes an electrical circuit portion of the second circuit board 105 to communicate an input signal to the first circuit board 100. The input signals are analyzed and used to subsequently produce output signals to activate or regulate the corresponding therapeutic devices 30.

The system 10 is illustrated in FIG. 2 having the front control panel 110 removed for clarity sake. The system frame 20 is provided with an interior cavity 70 which facilitates containment of various therapeutic devices 30. The cavity 70 is sectioned using a plurality of vertical dividers 72 which extend perpendicularly, thereby providing a designated space for each therapeutic device 30 (also see FIG. 3). The cavity 70 also provides a mounting means to a first circuit board 100 and a second circuit board 105 along an interior surface of the system frame 20. The circuit boards 100, 105 provide electrical and electronic equipment and components necessary for the operation of the system 10 (see FIG. 3).

Figure 3:
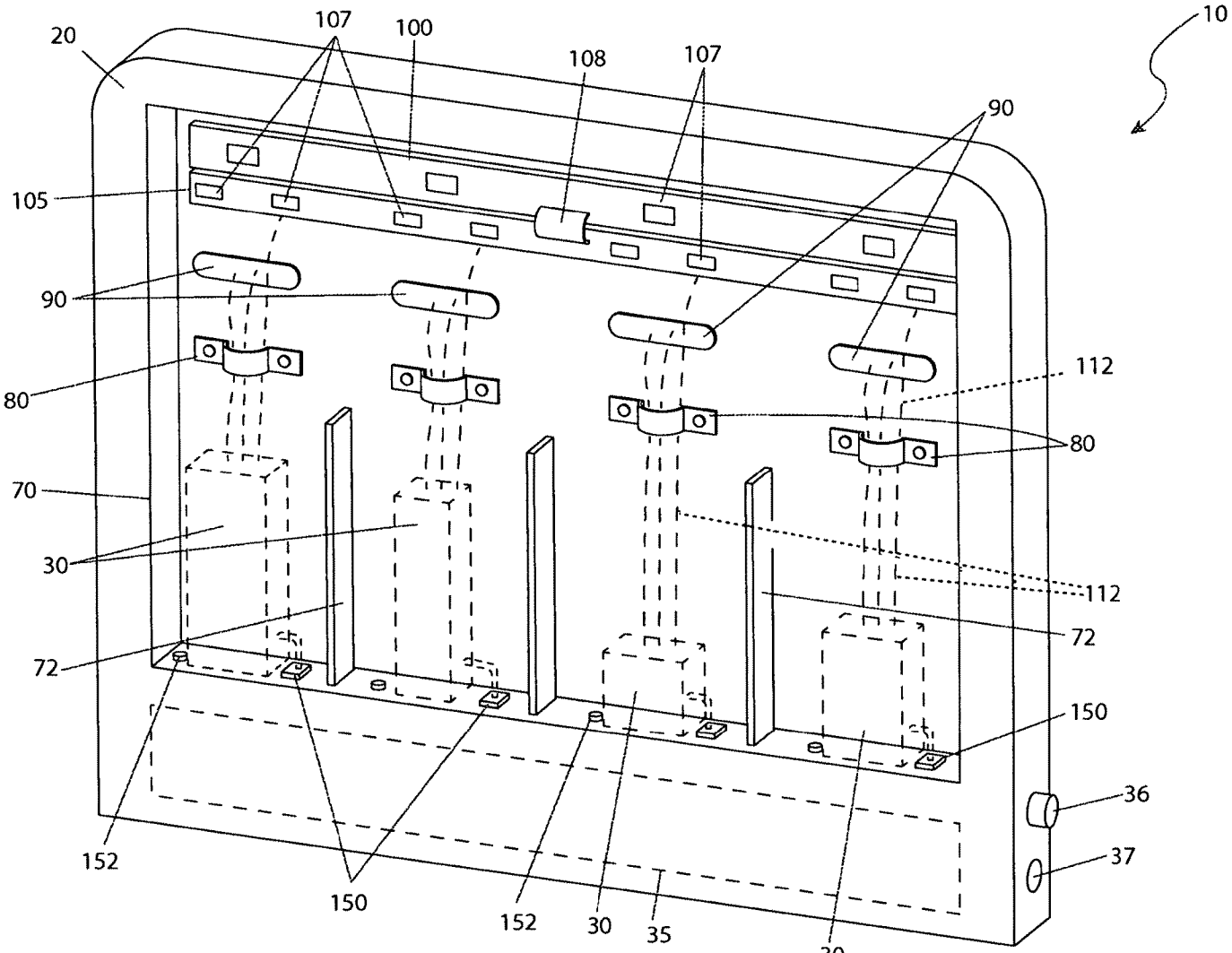
FIG. 3 is a front close-up view of a cavity portion 70 of the system 10, according to a preferred embodiment of the present invention; and, FIG. 4 is an electrical block diagram of the processing unit 12, of the system 10, according to a preferred embodiment of the present invention.

Referring now to FIG. 3, a front close-up view of a cavity portion 70 of the system 10, according to a preferred embodiment of the present invention, is disclosed. The cavity 70 provides equipment which enables electrical, fluid, and other communication with each therapeutic device 30 including a plurality of fastening straps 80, a plurality of portals 90, a plurality of electrical connections 150, and a plurality of fluid connections 152.

The fastening straps 80 provide flexible "U"-shaped restraining devices being anchored to an inside surface of the system frame 20, and are envisioned to use an elastic material or spring-like member to secure various wires 102 and tubes 112 associated with each therapeutic device 30. However, it is understood that other fastening straps 80 may be utilized without deviating from the teachings of the system 10, and as such should not be interpreted as a limiting factor of the system 10. The portals 90 provide rectangular or oval-shaped openings passing through a rear wall portion of the system frame 20 providing a means to route wires and tubing out of the system frame 20 and to the hospital bed 11 and/or directly to a patient. Each portal 90 is configured to facilitate wiring and tubing between the various therapeutic devices 30 and the patient lying in the hospital bed 11.

The system frame 20 provides a plurality of electrical connections 150 and fluid connections 152 positioned adjacent to each therapeutic device 30. The electrical connections 150 supply an electrical connection when required by the therapeutic device 30. The fluid connections 152 are envisioned to be easily connected devices such as a LUER CONNECTOR or similar device which provides the therapeutic devices 30 with a flow of fluid, such as water, from the reservoir 35 within the system frame 20. The fluid reservoir 35 is envisioned to be located within a lower portion of the system frame 20, providing an internal liquid vessel containing a fluid such as water, being required by fluid circulation type therapeutic devices 30. The reservoir 35 may be replenished as needed using integral fill connection 36 and drain plug 37 portions located along a side surface. Each fluid connection 152 is in fluid communication with the reservoir 35 and is envisioned to include a self-sealing quick-connect type device which works in conjunction with a mating connector mounted to tubing portions 112 of corresponding therapeutic devices 30 installed within the system 10. The fluid connectors 152 are preferably located on a floor of the internal cavity 70.

The cavity 70 further includes a first circuit board 100 and a second circuit board 105 which include electrical and electronic equipment and components necessary for the operation of the system 10. The first 100 and second 105 circuit boards communicate with each other as well as with the therapeutic devices 30 via circuit board connectors 107 and interconnecting wiring 102. The circuit boards 100, 105 are envisioned to receive power via a power cord 103 which is in electrical communication with power circuitry within the existing hospital bed 11 (see FIG. 4).

The first circuit board 100 provides microprocessor-based circuitry and software to provide operational instructions allowing the system 10 to function. Furthermore, the first circuit board 100 provides a plurality of display drivers enabling data and status information to appear upon the displays 120 mounted to the control panel 110.

The second circuit board 105 is envisioned to include a plurality of removably attached circuit board connectors 107 to establish electrical and electronic communication with the various therapeutic devices 30 within the cavity 70. The second circuit board 105 is in further electrical communication with the first circuit board 100 via a data cable 108 or similar board-to-board connection. The second circuit board 105 is envisioned to provide communication functions and to perform input/output operations to the first circuit board 100 which in turn performs algorithmic functions in accordance with software instructions.

The system frame 20 is illustrated here having four (4) therapeutic devices 30; however, it is understood that any practical number and type of devices 30 may be introduced and should not be interpreted as a limiting factor of the system 10. The system frame 20 is envisioned to include various therapeutic devices 30 such as, but not limited to: a temperature control pump (T/pump), a sequential pump, a foot pump, a mattress pump, and the like; however, it is understood that other devices may utilized without deviating from the teachings of the system 10, and as such should not be interpreted as a limiting factor of the system 10. It is understood that the therapeutic devices 30 are contained with the system frame 20 to minimize space while maintaining sufficient separation therebetween.

A T/pump is an apparatus that generates heat and transfers that heat to a flow of fluid such as water from the reservoir 35, which is in turn circulated through various devices in contact with a patient's body while lying in the hospital bed 11.

A sequential pump is an apparatus that supplies compressive pressure about certain areas of a body of a patient lying within the hospital bed 11. The compressive pressure applied by the sequential pump is typically produced by an air compressor and is transferred in the form of compressed air pulses through a system of tubing and/or cuffs that are placed about portions of the body of a patient lying in the hospital bed 11.

A foot pump is an apparatus that operates similar to the above-described sequential pump but is employed to one (1) or both of a patient's feet to stimulate physiological responses typically encountered from walking.

A mattress pump is an air compressor unit which supplies an uninterrupted flow of compressed air to inflate a bladder of a mattress portion of the hospital bed 11.

It is envisioned that any electrical wiring 102 or tubes 112 attached to the therapeutic devices 30 are to be routed through the portals 90 and directly to the hospital bed 11 and patient, thereby avoiding possible clutter and tripping hazards surrounding the hospital bed 11.

Figure 4:
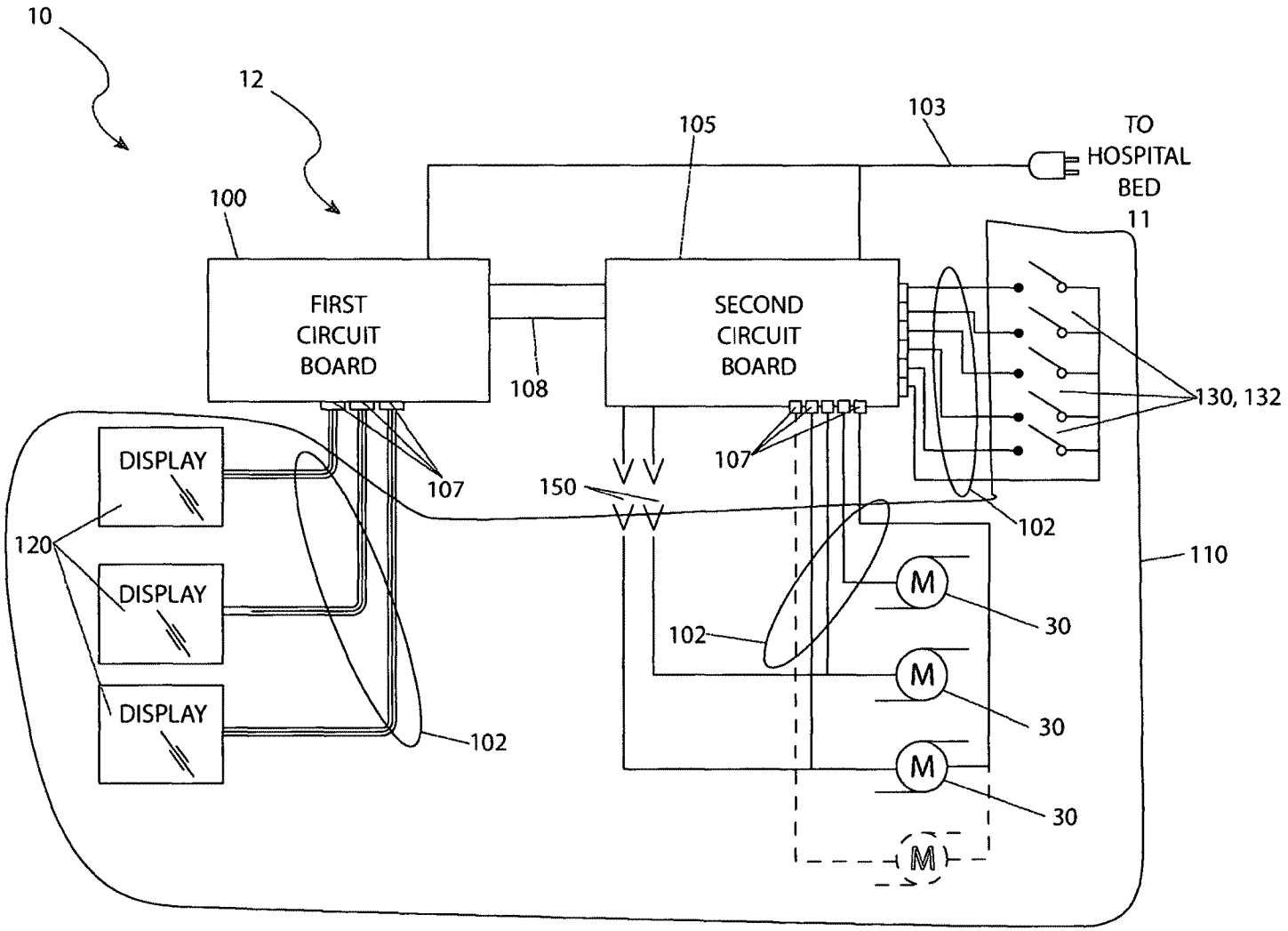

Referring now to FIG. 4, an electrical block diagram of the processing unit 12, of the system 10, according to a preferred embodiment of the present invention, is disclosed. The processing unit 12 includes a first circuit board 100 and a second circuit board 105 which include electrical and electronic equipment and components necessary for the operation of the system 10. The first 100 and second 105 circuit boards communicate with input and output portions via circuit board connectors 107 and interconnecting wiring 102. Power for the circuit boards 100, 105 is envisioned to be supplied from power residing upon the existing hospital bed 11 via connection of a power cord 103. The first circuit board 100 provides microprocessor-based circuitry and software and a plurality of display drivers enabling data and status information to appear upon a plurality of digital displays 120. The second circuit board 105 is envisioned to communicate with the various therapeutic devices 30, performing input/output operations in accordance with algorithmic functions of software instructions within the first circuit board 100, and to provide power to motor portions of each therapeutic device 30. The second circuit board 105 also receives input signals from the push buttons 130, 132 being electrically connected to the therapeutic devices 30 to provide control, operation, and programming functions.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the system 10, it would be installed as indicated in FIG. 1.

The method of utilizing the system 10 may be achieved by performing the following steps: acquiring the system 10; attaching the system 10 to an existing footboard portion of a hospital bed 11 using appropriate brackets and fasteners; plugging the power cord 103 into an outlet portion of the hospital bed 11; removing the control panel portion 110 from the system frame 20 by detaching the panel latches 115; disconnecting all circuit board connectors 107 from the first 100 and second 105 circuit boards, if not previously removed; removing the control panel 110; installing a desired number of, and types of, commercially-available therapeutic devices 30 between the dividers 72 within the cavity 70 necessary to perform the desired therapeutic functions to a patient lying the hospital bed 11; installing therapeutic devices 30 such as, but not limited to, a T/pump 30, a sequential pump 40, a foot pump 50, and a mattress pump 60; connecting control wiring 102 from each therapeutic device 30 to the second circuit board 105 using the circuit board connectors 107; routing remaining wiring 102 and fluid tubing 112 for each therapeutic device 30 through the portals 90 and making all necessary connections to mattress or patient-based portions of the therapeutic devices 30; connecting electrical and fluid supply portions of the therapeutic devices 30 to the electrical connections 150 and fluid connections 152 positioned adjacent to each therapeutic device 30 within the cavity 70; ensuring that fluid tubing 112 and electrical wiring 102 from each therapeutic device 30 are secured using the fastening straps 80; reconnecting all circuit board connectors 107 and replacing the control panel 110 to the system frame 20 using the panel latches 115; filling the reservoir 35 with a fluid such as water using the fill connection 36; pressing appropriate push buttons 130 and increment/decrement buttons 132 on the control panel 110 to initiate and manipulate the functions of each therapeutic device 30 within the apparatus 10 to provide therapy and treatments for a patient lying in the hospital bed 11; and, benefiting from the performance of therapy for a patient while eliminating the impedance associated with a myriad of stand-alone devices, carts, wiring, and tubing cluttering an area surrounding a hospital bed 11.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

The invention claimed is:

1. A therapeutic device control system, comprising:

a frame forming a footboard of a hospital bed, comprising:

a plurality of sidewalls defining an interior cavity to removably contain a plurality of interchangeable therapeutic devices;

a plurality of portals disposed through said frame, each portal of said plurality of portals is associated with an associated therapeutic device of said plurality of interchangeable therapeutic devices to permit routing of at least one of fluid tubing and electrical wiring, coupled to said associated therapeutic device, from within said interior cavity of said frame to an exterior of said frame;

a plurality of electrical connections positioned within said interior cavity of said frame, each electrical connection of said plurality of electrical connections is associated with said associated therapeutic device of said plurality of interchangeable therapeutic devices to transfer electrical power to said associated therapeutic device;

a fluid reservoir located within said interior cavity of said frame to retain a volume of liquid;

a plurality of fluid connections positioned within said interior cavity of said frame, each fluid connection of said plurality of fluid connections is associated with said associated therapeutic device of said plurality of interchangeable therapeutic devices to supply said liquid to said associated therapeutic device;

a processing unit disposed within said interior cavity of said frame, comprising:

a first circuit board disposed within said interior cavity;

a second circuit board disposed within said interior cavity and in electrical communication with said first circuit board and each therapeutic device of said plurality of therapeutic devices;

a control panel removably coupled to said frame to activate, control and monitor said each therapeutic device, said control panel, comprising:

a plurality of button controls, each button control of said plurality of button controls is in electrical communication with said first circuit board to provide activation and control inputs to said first circuit board for activating and controlling an operational condition of said plurality of interchangeable therapeutic devices;

a plurality of displays, each display of said plurality of displays is associated with said associated therapeutic device of said plurality of interchangeable therapeutic devices and is in electrical communication with said first circuit board to present data corresponding to said operational condition of said associated therapeutic device;

a plurality of fastening straps coupled to said frame within said internal cavity, each fastening strap of the plurality of fastening straps is associated with said associated therapeutic device of said plurality of interchangeable therapeutic devices to secure said at least one of said fluid tubing and said electrical wiring of said associated therapeutic device to an inside surface of said frame, wherein said each fastening strap comprises a "U"-shaped elastic retaining device anchored to said frame; and at least one latching device removably connected said control panel to said frame, wherein said fluid reservoir is provided with a fill connection and a drain plug to enable replacement and replenishment of said liquid.

2. The system recited in claim 1, wherein said second circuit board is provided with a plurality of circuit board connectors, each circuit board connector of said plurality of circuit board connectors to establish temporary communication with said associated therapeutic device.

3. The system recited in claim 1, wherein said frame further comprises a plurality of internal dividers disposed within said internal cavity to partition said internal cavity into a plurality of designated areas, each designated area of said plurality of designated areas is associated with said associated therapeutic device of said plurality of interchangeable therapeutic devices to contain said associated therapeutic device.

4. The system recited in claim 1, further comprising a plurality of labels disposed on said control panel, each label of said plurality of labels is associated with an associated display of said plurality of displays to indicate pertinent information about said associated display.

5. The system recited in claim 1, wherein said first circuit board is an algorithmic function on said activation and control inputs and generate activation and control outputs and said second circuit board to control said plurality of interchangeable therapeutic devices in response to said activation and control outputs.

* * * * *